US006977565B2

(12) United States Patent
Shimizu et al.

(10) Patent No.: US 6,977,565 B2
(45) Date of Patent: Dec. 20, 2005

(54) DIELECTRIC FILTER

(75) Inventors: Daisuke Shimizu, Kobe (JP); Hiroyuki Taguchi, Daito (JP); Masahisa Nakaguchi, Katano (JP)

(73) Assignee: Sanyo Electric Co., Ltd., Moriguchi (JP)

( * ) Notice: Subject to any disclaimer, the term of this patent is extended or adjusted under 35 U.S.C. 154(b) by 0 days.

(21) Appl. No.: 10/667,509

(22) Filed: Sep. 23, 2003

(65) Prior Publication Data

US 2004/0066255 A1 Apr. 8, 2004

(30) Foreign Application Priority Data

Sep. 25, 2002 (JP) ..... 2002-278884

(51) Int. Cl.[7] ..... H01P 1/205
(52) U.S. Cl. ..... 333/206; 333/207
(58) Field of Search ..... 333/202, 206, 333/207, 222, 223

(56) References Cited

U.S. PATENT DOCUMENTS 4,733,208 A * 3/1988 Ishikawa et al. ..... 333/202
5,146,193 A * 9/1992 Sokola ..... 333/206
5,537,082 A * 7/1996 Tada et al. ..... 333/202
5,612,654 A 3/1997 Tsujiguchi et al. ..... 333/202
5,652,555 A * 7/1997 Tada et al. ..... 333/202
6,784,767 B2 * 8/2004 Hiroshima et al. ..... 333/206

FOREIGN PATENT DOCUMENTS

JP 7-254806 10/1995

* cited by examiner

*Primary Examiner*—Seungsook Ham
(74) *Attorney, Agent, or Firm*—Armstrong, Kratz, Quintos, Hanson & Brooks, LLP

(57) ABSTRACT

A dielectric filter including a dielectric block having two through bores, an outer conductor covering an outer peripheral surface of the block and one end face of the block, an inner conductor covering an inner periphery of the block, and a pair of input and output electrodes formed on the surface of the block, the other end face of the block being in the form of an open end face having no conductor layer. The pair of input and output electrodes are opposed to each other on one plane, and a dielectric block exposing portion having no conductor layer thereon is formed between the two electrodes. The block is provided in the other end face thereof with one groove dividing the open end face, and an inner surface defining the groove is provided with a conductor layer joined to the outer conductor.

4 Claims, 5 Drawing Sheets

DIELECTRIC FILTER

BACKGROUND OF THE INVENTION

1. Field of the Invention

The present invention relates to dielectric filters to be incorporated into mobile communications devices for determining the frequency band pass characteristics of signals to be processed.

2. Description of the Related Art

With mobile communications devices such as portable telephones adapted to have a multiplicity of functions in recent years, it is required that these devices be usable for a multiplicity of bands and have satisfactory frequency characteristics in wide frequency bands. It is known that dielectric filters are used in such mobile communications devices for transmitting and receiving signals, for example, in a frequency band of hundreds of megahertz to several gigahertz. FIG. 7 shows the construction of a dielectric filter for use in conventional mobile communications devices (see JP-B No. 7-254806).

With reference to FIG. 7, a dielectric block 1 in the form of a rectangular parallelepiped and made from a dielectric material such as a ceramic material has two through bores 2, 4 extending through the block from the front end face 14 thereof to the rear end face 12 thereof. The through bores 2, 4 comprise large-diameter bore portions 21, 41 and small-diameter bore portions 22, 42, respectively. An outer conductor 5 comprising a conductor layer of silver or the like is formed over the outer peripheral surface (upper and lower surfaces and opposite side surfaces) of the dielectric block 1. An inner conductor 3 is formed over each of the inner peripheral surfaces of the block defining the through bores 2, 4. A conductor layer is formed also on the rear end face 12 of the block 1 to provide a short-circuiting end face for short-circuiting the outer conductor 5 and the inner conductor 3. The dielectric block 1 is left exposed over the front end face 14 thereof to provide an open end face to leave the through bore 2 and the inner conductor 3 open.

A pair of input and output electrodes 6, 6 each comprising a conductor layer are formed on the outer peripheral surface of the block 1. Electrode separating regions 8, 8 are formed between the outer conductor 5 and the input and output electrodes 6, 6 by cutting out the conductor layer. A bridge portion 51 comprising a part of the outer conductor 5 is formed between the input and output electrodes 6, 6.

FIG. 9 is an equivalent circuit diagram of the conventional dielectric filter described. A pair of resonators A, A are coupled to the input and output electrodes 6, 6, respectively, each via a capacitance C1, and the two resonators A, A are coupled to each other by a magnetic field M.

FIG. 8 shows the frequency characteristics of the conventional dielectric filter described. There is an attenuation pole c1 at the high frequency side of a pass band a1, and there is an attenuation pole b1 at the low frequency side thereof, whereby a band pass filter is realized.

With the dielectric filter shown in FIG. 7, a resonance frequency is set in the desired pass band a1 by varying the axial lengths of the small-diameter bore portions 22, 42 of the through bores 2, 4, and the width of the pass band is adjustable by varying the distances of the input and output electrodes 6, 6 from the large-diameter bore portions 21, 41 of the through bores 2, 4 and thereby varying the degree of the capacitance coupling.

With the conventional dielectric filter shown in FIG. 7, the position (frequency) of the attenuation pole b1 at the low frequency side is adjustable to some extent by altering the external dimensions of the dielectric block and the arrangement of the large-diameter bore portions and the small-diameter bore portions of the through bores, whereas difficulty is encountered in making a similar adjustment of the attenuation pole c1 at the high frequency side. Moreover, the fabrication of the filter involves the problem that it is very cumbersome to alter the shape of the through bores of the dielectric block.

Although the attenuation characteristics in a high frequency band outside the pass band also become important because communications devices in recent years are adapted to have a multiplicity of functions, conventional dielectric filters have the problem of being unable to fully attenuate a higher harmonic e1 produced in a high frequency band (around 5 GHz) corresponding to about 3 times the pass band a1 as shown in FIG. 8 and being seriously impaired in filter characteristics.

SUMMARY OF THE INVENTION

An object of the present invention is to provide a dielectric filter having frequency characteristics in the pass band which are improved by increasing the number of attenuation poles, the filter being adapted to fully suppress a higher harmonic produced in a high frequency band.

The present invention provides a dielectric filter which comprises a dielectric block in the form of a rectangular parallelepiped and having a plurality of through bores extending therethrough in parallel to each other, an outer conductor in the form of a conductor layer and covering an outer peripheral surface of the block in parallel to the extending direction of the through bores and one end face of the block wherein one end of each of the through bores has an opening, an inner conductor in the form of a conductor layer and covering an inner periphery of the block defining each of the through bores, and a pair of input and output electrodes formed on the surface of the block and separated from the outer conductor. The other end face of the block wherein the other ends of the through bores have openings is in the form of an open end face having no conductor layer. The pair of input and output electrodes are opposed to each other on one plane providing the outer peripheral surface of the block, and a dielectric block exposing portion having no conductor layer thereon is formed between the two electrodes. The block is provided in the other end face thereof with at least one groove dividing the open end face, and the groove is provided with a conductor in conduction with the outer conductor.

With the dielectric filter of the present invention, the pair of input and output electrodes are directly opposed to each other to thereby provide second capacitance coupling between the two electrodes, whereby an additional attenuation pole is formed anew. The frequency characteristics in the pass band are therefore improved by a larger number of attenuation poles than is conventionally available. The structure wherein the open end face is divided by the groove provides a fortified ground for the filter, with the result that a higher harmonic having three times the frequency of the pass band can be fully suppressed.

DETAILED DESCRIPTION OF THE EMBODIMENT

Figure 1:
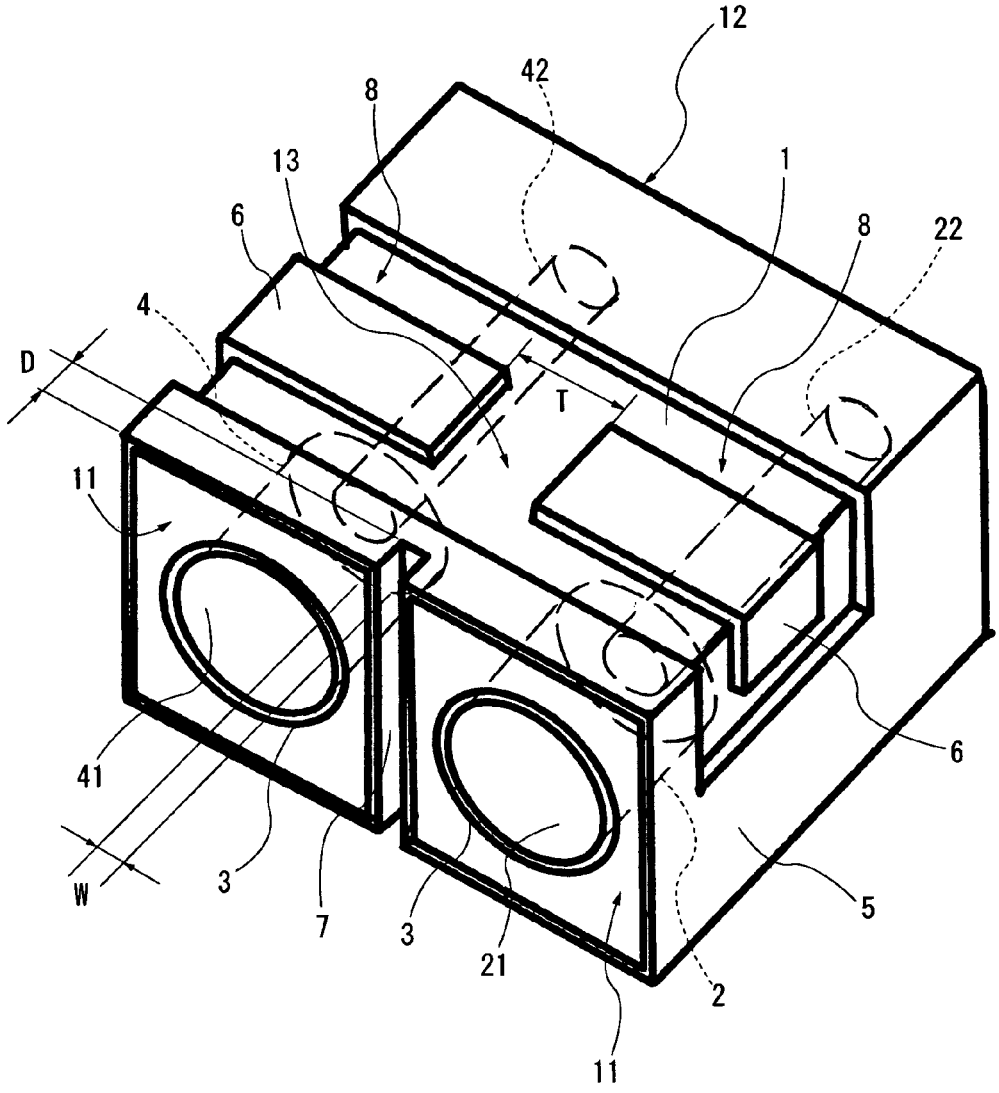
FIG. 1 is a perspective view showing an embodiment of dielectric filter according to the invention.

An embodiment of the invention will be described below in detail with reference to the drawings. FIG. 1 shows a dielectric filter embodying the invention and comprising a dielectric block 1 in the form of a rectangular parallelepiped and made, for example, from a ceramic material of the $BaTiO_3$ type. The dielectric block 1 has two through bores 2, 4 extending through the block from the front end face 11 thereof to the rear end face 12 thereof. Each of the through bores 2, 4 comprises a large-diameter bore portion 21, 41 and a small-diameter bore portion 22, 42 extending from the bore portion 21, 41 and coaxial therewith.

An outer conductor 5 comprising a conductor layer of silver or the like is formed over the outer peripheral surface (upper and lower surfaces and opposite side surfaces) of the dielectric block 1. An inner conductor 3 is formed over each of the inner peripheral surfaces of the block defining the through bores 2, 4. A conductor layer is formed also on the rear end face 12 of the block 1 to provide a short-circuiting end face for short-circuiting the outer conductor 5 and the inner conductor 3. The dielectric block 1 is left exposed over the front end face 11 thereof to provide an open end face for leaving the through bore 2 and the inner conductor 3 electrically open.

A pair of input and output electrodes 6, 6 each comprising a conductor layer are formed on the outer peripheral surface of the block 1. Electrode separating regions 8, 8 are formed between the outer conductor 5 and the input and output electrodes 6, 6 by cutting out the conductive layer. The input and output electrodes 6, 6 are opposed to each other on one plane providing the outer peripheral surface of the dielectric block 1, and a dielectric block exposing portion 13 having no conductor layer is formed between the two electrodes 6, 6.

Formed in the open end face 11 of the dielectric block is a groove 7 extending between the two through bores 2, 4 having respective openings in the open end face 11 to divide the open end face 11 in two. The inner surface defining the groove 7 is provided with a conductor layer providing a portion of the outer conductor 5.

The dielectric filter having the above construction is usable to provide a filter of two-stage structure having a pass band, for example, with a center frequency of 1575 MHz. When the pass band is determined in this case, the block size of the dielectric filter and the size of through bores thereof are determined in accordance with the material of the block. The dielectric filter measures, for example, approximately 3.5 mm×3.6 mm×1.8 mm.

Figure 3:
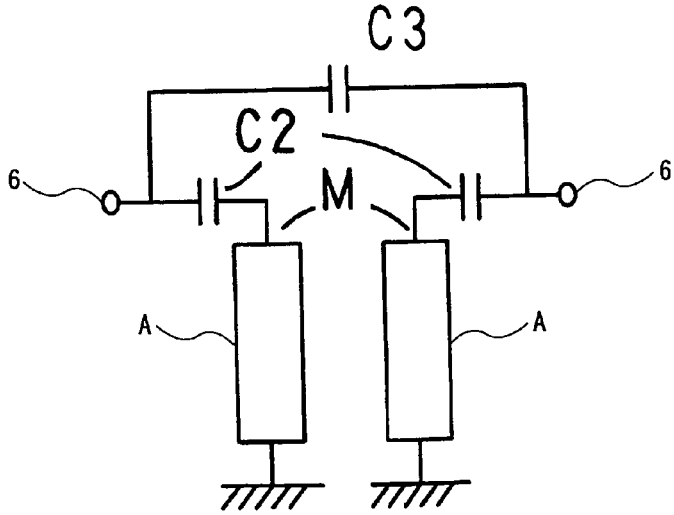
FIG. 3 is an equivalent circuit diagram of the dielectric filter.

FIG. 3 shows an equivalent circuit diagram of the dielectric filter embodying the invention. A pair of resonators A, A are coupled to the input and output electrodes 6, 6, respectively, each via a first capacitance C2, and the two resonators A, A are coupled to each other by a magnetic field M. The two input and output electrodes 6, 6 are further connected to each other via a second capacitance C3. The second capacitance C3 is provided by positioning the pair of input and output electrodes 6, 6 as opposed to each other without interposing any conductor layer therebetween.

Figure 2:
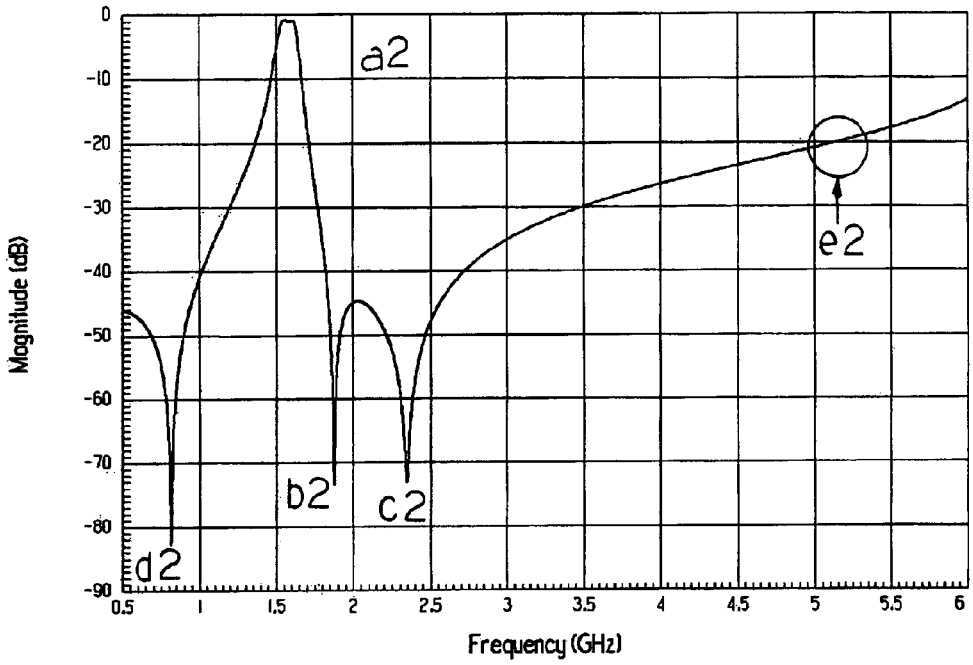
FIG. 2 is a diagram showing the frequency characteristics of the dielectric filter.

FIG. 2 shows the frequency characteristics of the dielectric filter according to the foregoing embodiment. At the high frequency side of the pass band a2, there are an attenuation pole b2 corresponding to the conventional attenuation pole b1 and another attenuation pole c2 corresponding to the conventional attenuation pole c1, and an attenuation pole d2 appears anew at the low frequency side (around 800 MHz). Consequently, the band pass filter thus realized has sharp attenuation characteristics. A higher harmonic e2 having approximately three times the frequency of the pass band is fully suppressed.

The attenuation pole b2 at the high frequency side of the pass band corresponds to the conventional attenuation pole b1 at the low frequency side, as shifted toward the high frequency side of the pass band. This is attributable to a change of the coupling relationship between the resonators from the capacitive type to the inductive type due to the provision of the groove 7 in addition to the magnetic coupling between the resonators. Further the appearance of the new attenuation pole d2 at the low frequency side of the pass band is due to the second capacitance coupling C3 produced by the foregoing opposed relationship between the pair of input and output electrodes.

Thus, the dielectric filter embodying the invention realizes frequency characteristics having three attenuation poles, so that filters can be realized which are adapted to separate signals of pass bands of different standard (in the cellular telephone system in use in the U.S., 800-MHz-band which is AMPS band at the low frequency side of the pass band, or 1.8-GHz-band which is DCS band or 2.4-GHz-band for use in LAN at the high frequency side thereof), unlike the original pass band (for example, of 1575 MHz), and which are applicable to communications devices for use with a multiplicity of bands. Stated more specifically, the attenuation pole d2 appearing anew at the low frequency side of the pass band can be assigned to the band of 800 MHz, and the two attenuation poles b2 and c2 present at the high frequency side of the pass band can be assigned to the band of 1800 MHz, i.e., DCS band, and 2.4-GHz-band for LAN.

Figure 4:
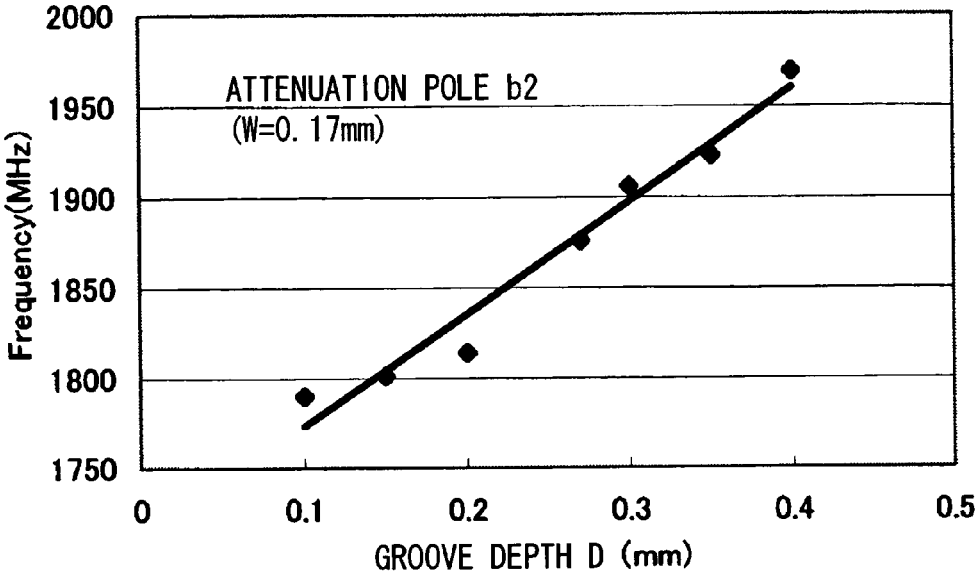
FIG. 4 is a graph showing the relationship between the depth of a groove and the frequency of an attenuation pole.
Figure 5:
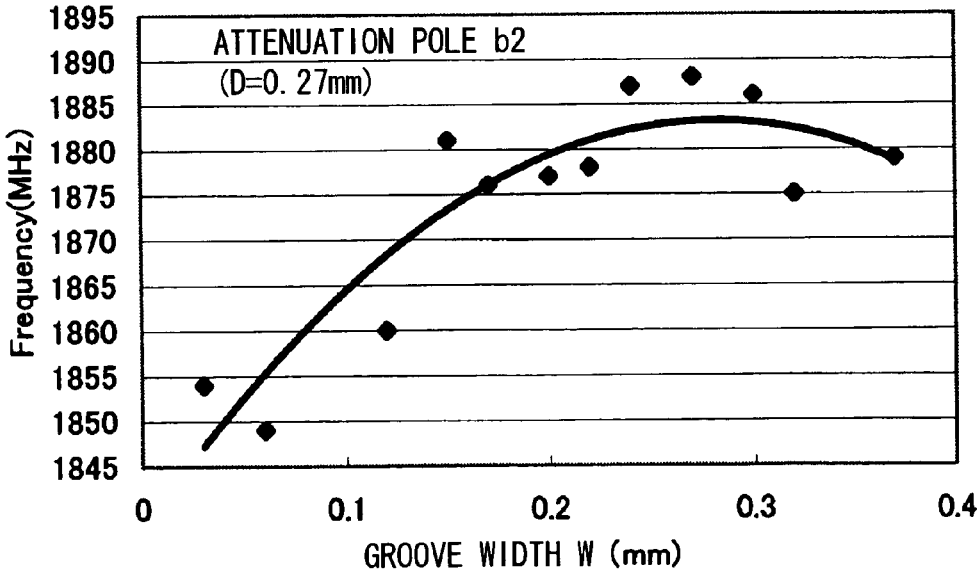
FIG. 5 is a graph showing the relationship between the groove width and the frequency of the attenuation pole.
Figure 6:
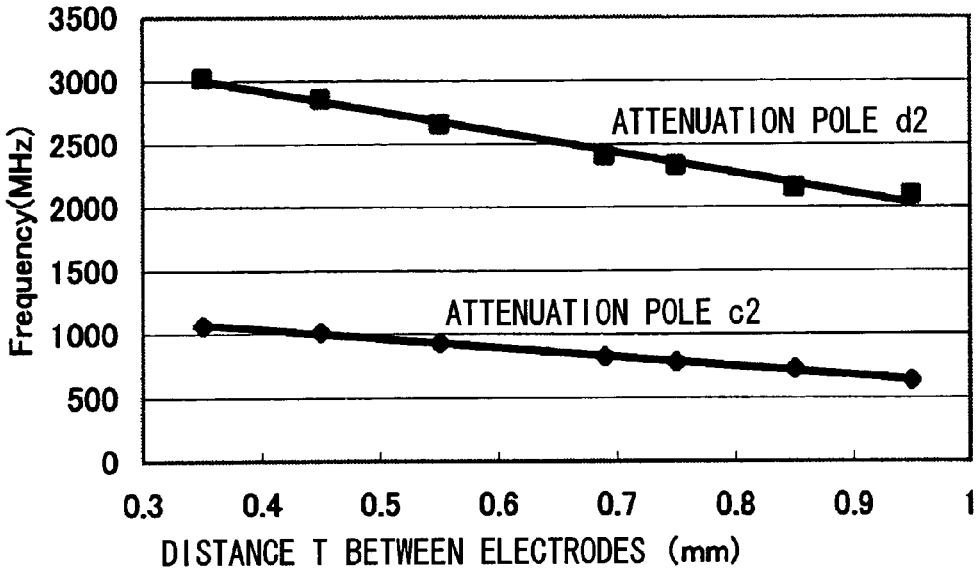
FIG. 6 is a graph showing the relationship between the distance between input and output electrodes and the frequency of attenuation poles.
Figure 7:
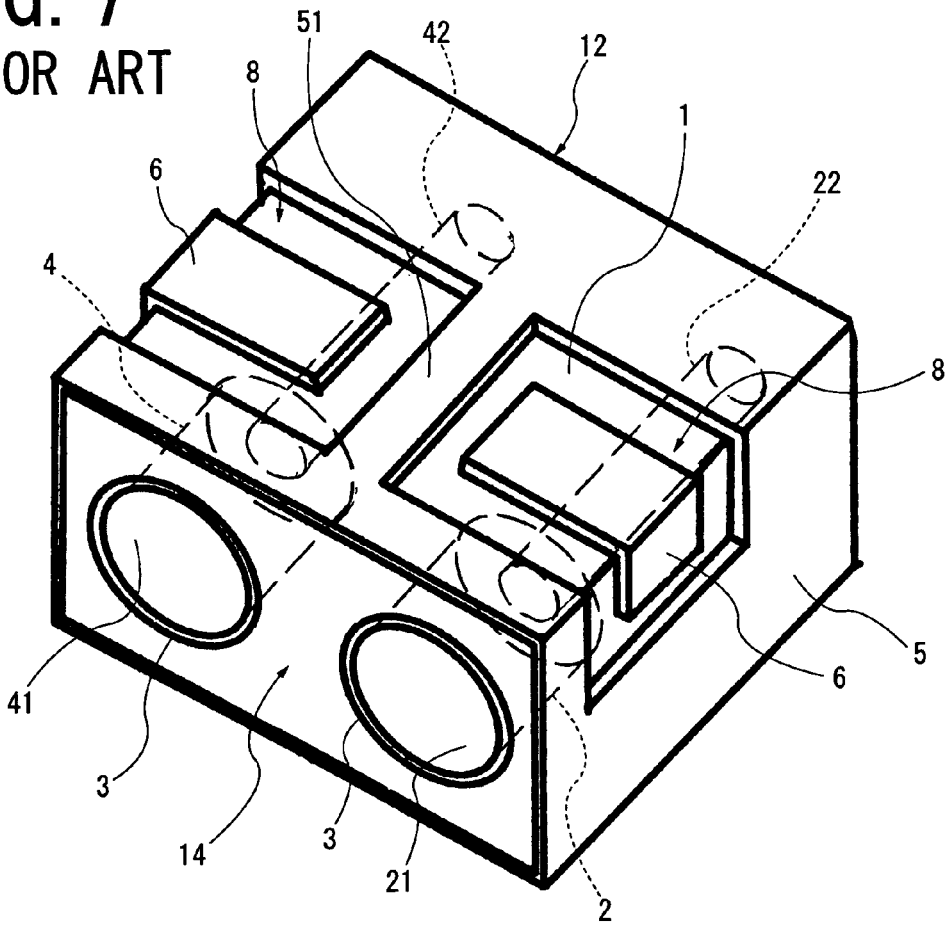
FIG. 7 PRIOR ART
FIG. 7 is a perspective view showing a conventional dielectric filter.
Figure 8:
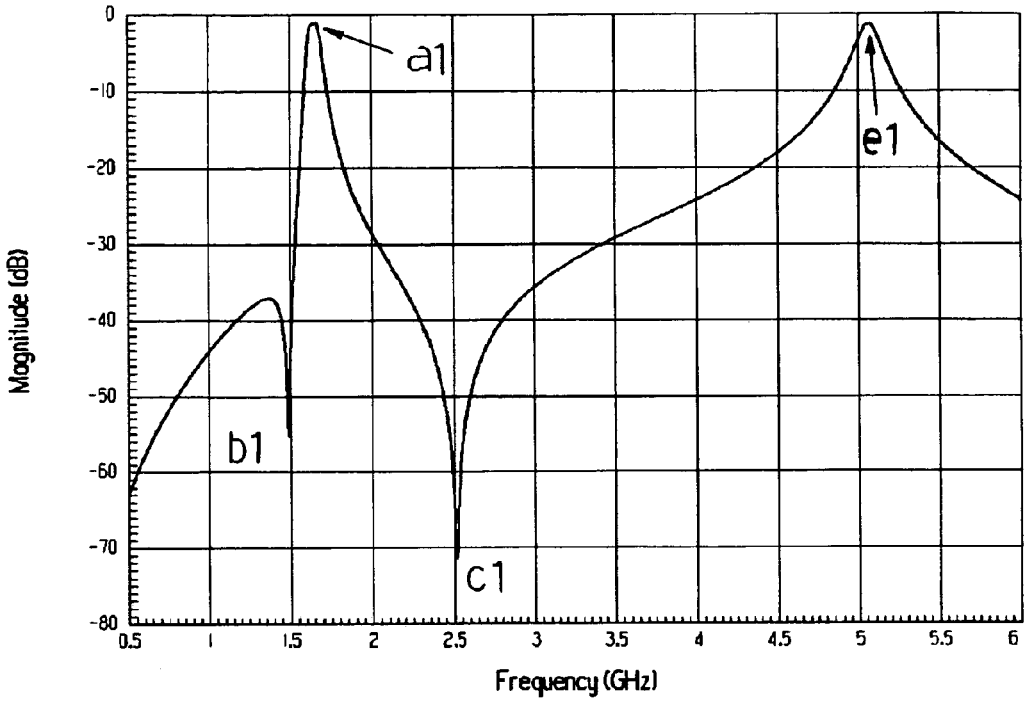
FIG. 8 is a diagram showing the frequency characteristics of the dielectric filter.
Figure 9:
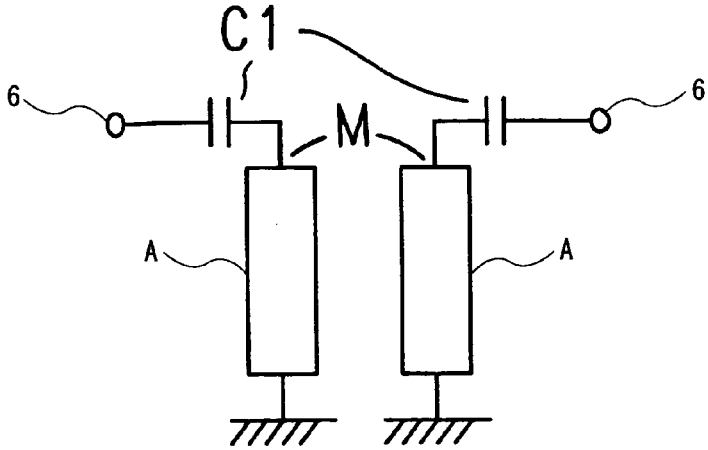
FIG. 9 is an equivalent circuit diagram of the dielectric filter.

FIGS. 4 to 6 are graphs showing results of experiments conducted to measure variations in the frequency of attenuation pole or poles when the depth D or width W of the groove 7 shown in FIG. 1, or the distance T between the input and output electrodes was altered, respectively. The graphs of FIGS. 4 and 5 indicate that the frequency of the attenuation pole b2 at the high frequency side of the pass band is adjustable by varying the depth D or width W of the groove. The graph of FIG. 6 reveals that the frequencies of the attenuation pole d2 at the low frequency side of the pass band and the attenuation pole c2 at the high frequency side thereof can be adjusted by varying the distance T between the input and output electrodes. Thus, the frequencies of the three attenuation poles can be altered to provide attenuation poles at desired frequencies by suitably varying the above dimensions.

The conductor layer formed on the inner surface defining the groove 7 provides a fortified ground around the through bores 2, 4 which have openings in the open end face 11, so that the higher harmonic e2 having three times the frequency of the pass band can be fully suppressed. This ensures the application of the filter also to high-frequency transmission devices for use in wireless LAN.

With the dielectric filter of the present invention described above, a pair of input and output electrodes are directly opposed to each other with no conductor layer interposed therebetween to thereby provide second capacitance coupling between the two electrodes and cause an additional attenuation pole d2 to appear anew. Furthermore, the structure wherein the open end face 11 is divided by the groove 7 provides a fortified ground for the filter to ensure satisfactory suppression of higher harmonic.

The attenuation pole d2 at the low frequency side of the pass band and the attenuation pole c2 at the high frequency side thereof are adjustable in frequency by varying the distance between the pair of input and output electrodes, while the frequency of the attenuation pole b2 at the high frequency side of the pass band can be adjusted by varying the width and depth of the groove. The attenuation poles in the vicinity of the pass band can therefore be adjusted as desired. This makes it possible to design filters adapted for use in a multiplicity of varying bands.

What is claimed is:

1. A dielectric filter comprising:

a dielectric block in the form of a rectangular parallelepiped and having a plurality of through bores extending therethrough in parallel to each other;

an outer conductor in the form of a conductor layer and covering an outer peripheral surface of the block in parallel with the extending direction of the through bores and one end face of the block wherein one end of each of the through bores has an opening;

an inner conductor in the form of a conductor layer and covering an inner periphery of the block defining each of the through bores; and a pair of input and output electrodes formed on a surface of the block and separated from the outer conductor, wherein the other end face of the block in which the other ends of the through bores have openings is in the form of an open end face having no conductor layer, wherein the pair of input and output electrodes are opposed to each other on one plane providing the outer peripheral surface of the block, wherein a dielectric block exposing portion is formed all over the region of said one plane between the input and output electrodes and having no conductor layer thereon, wherein the block is provided in said other end face thereof with at least one groove dividing the open end face, wherein the groove is provided with a conductor in conduction with the outer conductor, and wherein a distance between the input and output electrodes is set such that one attenuation pole appears at a low frequency side of the pass band, and a width and depth of the groove are set such that two attenuation poles appear at a high frequency side of the pass band.

2. A dielectric filter according to claim 1, wherein the conductor provided in the groove comprises a conductor layer formed on an inner surface defining the groove and joined to the outer conductor.

3. A dielectric filter according to claim 1, wherein the groove extends between the through bores having the openings in the open end face.

4. A dielectric filter according to claim 1, wherein each of the through bores comprises a large-diameter bore portion and a small-diameter bore portion joined thereto in the extending direction of the bore.

* * * * *